United States Patent [19]

Maynard, Jr.

[11] Patent Number: 4,600,125

[45] Date of Patent: Jul. 15, 1986

[54] LIQUID FUNNEL AND POURING SPOUT COMBINATION

[76] Inventor: Walter P. Maynard, Jr., 8613 Roswell Rd., Building Two, Suite 100, Atlanta, Ga. 30338

[21] Appl. No.: 771,488

[22] Filed: Sep. 3, 1985

Related U.S. Application Data

[63] Continuation of Ser. No. 523,017, Aug. 15, 1983, abandoned.

[51] Int. Cl.[4] ..... B67B 7/48; B67C 11/00

[52] U.S. Cl. ..... 222/81; 222/88; 222/460; 222/529; 222/563; 141/330; 141/331; 220/287

[58] Field of Search ..... 222/80, 81, 83, 83.5, 222/85-91, 189, 192, 460-462, 465 R, 526, 527, 529, 537, 539, 544, 566-568, 570; 220/287, 85 F, 85 SP, 85 B, 85 R, 86 R; 141/19, 330-345, 199-205, 98, 311 R, 367, 368

[56] References Cited

U.S. PATENT DOCUMENTS

| | | | |
|---|---|---|---|
| 559,905 | 5/1896 | Pike | 141/331 X |
| 1,387,211 | 8/1921 | Sweeny | 222/539 |
| 1,429,566 | 9/1922 | Carlile | 220/287 |
| 1,761,072 | 6/1930 | Dohrmann | 222/539 |
| 2,556,627 | 6/1951 | Miksis | 222/527 X |
| 3,058,632 | 10/1962 | Stremmel | 222/567 |
| 3,865,270 | 2/1975 | Petersson | 222/539 X |
| 3,939,884 | 2/1976 | Mader | 141/333 |
| 4,149,575 | 4/1979 | Fisher | 141/98 |
| 4,217,940 | 8/1980 | Wheeler | 222/568 X |
| 4,267,945 | 5/1981 | Maynard, Jr. | 222/83.5 |
| 4,273,166 | 6/1981 | Bradley | 141/340 X |
| 4,338,983 | 7/1982 | Hatcher | 141/339 X |

FOREIGN PATENT DOCUMENTS

| | | | |
|---|---|---|---|
| 2350818 | 1/1978 | France | 222/91 |
| 2081128 | 2/1982 | United Kingdom | 141/331 |
| 2081129 | 2/1982 | United Kingdom | 141/331 |

*Primary Examiner*—Joseph J. Rolla
*Assistant Examiner*—Kevin P. Shaver
*Attorney, Agent, or Firm*—William H. Needle; Sumner C. Rosenberg

[57] ABSTRACT

A convenient, spill-resistant and highly versatile pouring system for containerized liquids is disclosed. A primary funnel includes a container seating well having a built-in container piercing element. The primary funnel is inverted and placed over a liquid container or vice versa to carry out the piercing operation, following which the primary funnel and pierced container are in an upright position so that the reduced diameter pouring spout of the primary funnel can enter an aperture of a receiver of the liquid. Easily attachable secondary and tertiary pouring spout extensions allow pouring from the primary funnel into receivers having restricted openings and into receivers at relatively inaccessible locations. A convenient closure plug adapted to fit all pouring spouts of the system is provided. The secondary pouring spout can also be conveniently coupled with a standard size outlet of a bulk liquid storage container.

1 Claim, 5 Drawing Figures

LIQUID FUNNEL AND POURING SPOUT COMBINATION

This is a continuation of application Ser. No. 523,017, filed Aug. 15, 1983, now abandoned.

BACKGROUND OF THE INVENTION

The objective of this invention is to provide an improved pouring apparatus or system for containerized liquids, such as motor oils and the like.

More particularly, the invention seeks to provide a very convenient, clean and versatile pouring system which includes the provision for piercing a container of liquid; followed by the delivery of the containerized liquid without spillage into another container or into an opening, such as the crankcase filler pipe, gas tank, radiator, windshield washer tank, transmission fill point, power steering reservoir, brake fluid cylinder, etc. of a vehicle.

In accordance with a major feature of the invention, a primary funnel having the container piercing means therein includes a tapered pouring spout of a size suitable for entry into medium or large-sized fluid openings in a vehicle for maximum flow rate and pouring stability. A convenience handle is provided on the primary funnel. To facilitate delivery the containerized liquid into other receivers which may have small inlets or may be relatively inaccessible, secondary and tertiary pouring spouts are provided, at least one of which can be threadedly coupled to the primary funnel and also can be threadedly coupled to the tertiary spout which is elongated and flexible to enable reaching relatively inaccessible receivers. A single closure plug of stepped construction is provided whereby the outlet of the primary funnel and the secondary and tertiary spouts can be closed to prevent spillage or leakage when stored. The secondary pouring spout has its threaded coupling sized and designed to receive a standard diameter threaded neck of a bulk storage container for gasoline or other liquids; the secondary funnel by itself, or combined with the primary and/or tertiary funnel, can be coupled on a container to fill into the container in a stable manner or pour therefrom.

A further object of the invention is to improve upon the convenience, utility and versatility of the liquid funnel and container piercing device of U.S. Pat. No. 4,267,945.

Other objects and advantages of the invention will become apparent to those skilled in the art during the course of the following detailed description.

DETAILED DESCRIPTION

Figure 1:
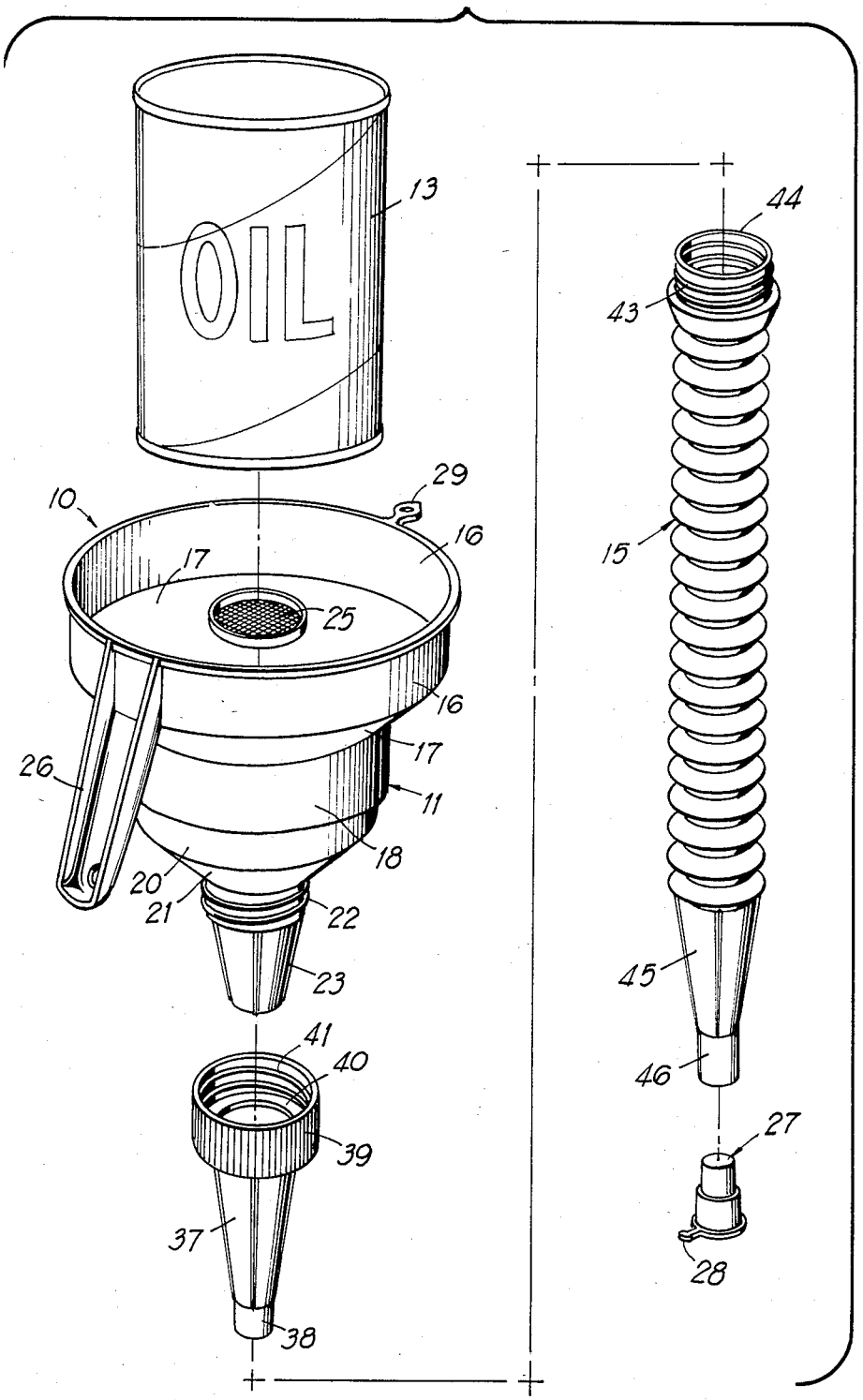
FIG. 1 is an exploded perspective view of a containerized liquid pouring system according to the present invention.

Referring to the drawings in detail, wherein like numerals designate like parts, a containerized liquid pouring system 10 according to the invention is shown in its entirety in FIG. 1. The pouring system comprises a primary pouring funnel 11 having built-in means 12 to pierce the container 13 of liquid, such as motor oil.

The pouring system additionally comprises secondary (or first auxiliary) and tertiary (or second auxiliary) pouring spout attachments 14 and 15 whose use and operation in conjunction with the primary funnel 11 will be fully described.

The primary funnel 11 includes an upper main bowl 16 of cylindrical form descending to a conically tapered wall 17, in turn leading to a somewhat reduced diameter cylindrical portion or wall 18 of a size to receive therein the liquid container 13, typically a quart size can of motor oil formed of thin metal, plastic or paper.

Figure 2:
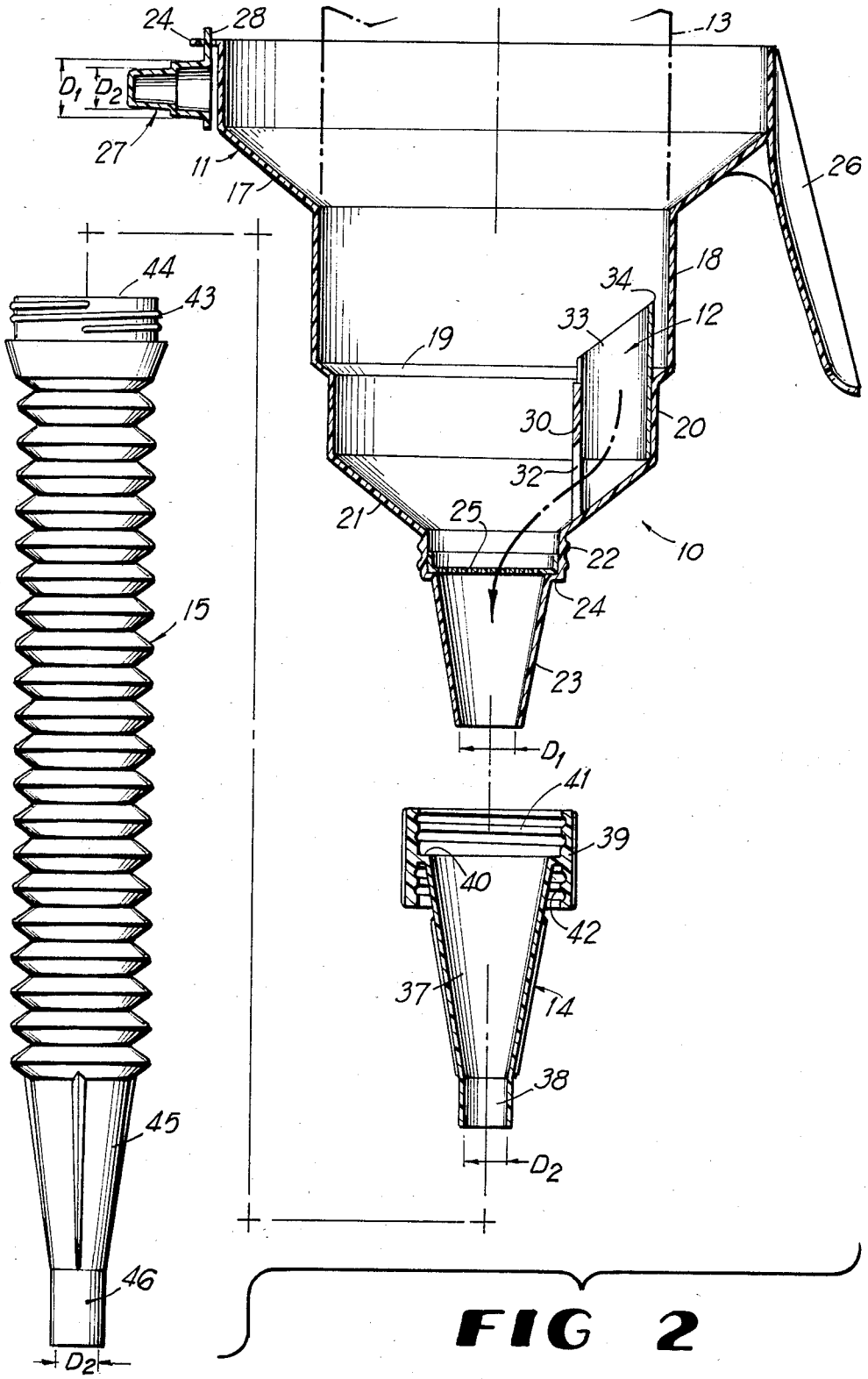
FIG. 2 is an exploded central vertical section through the system, partly in elevation.
Figure 3:
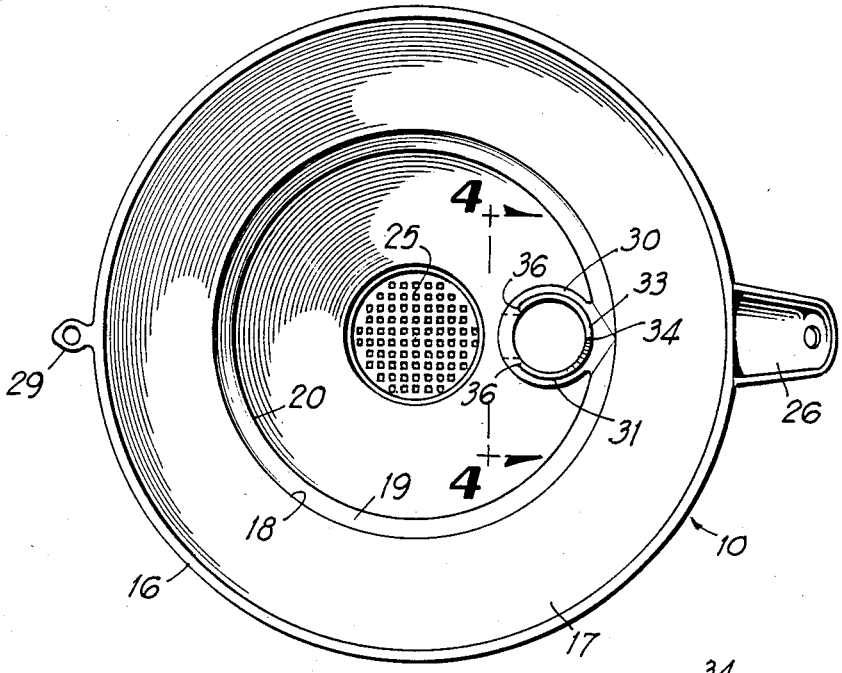
FIG. 3 is a plan view of a primary funnel forming a part of the system.
Figure 4:
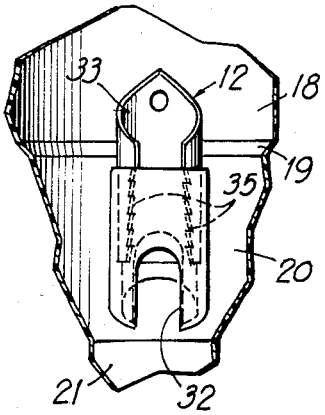
FIG. 4 is a fragmentary vertical section taken on line 4—4 of FIG. 3.
Figure 5:
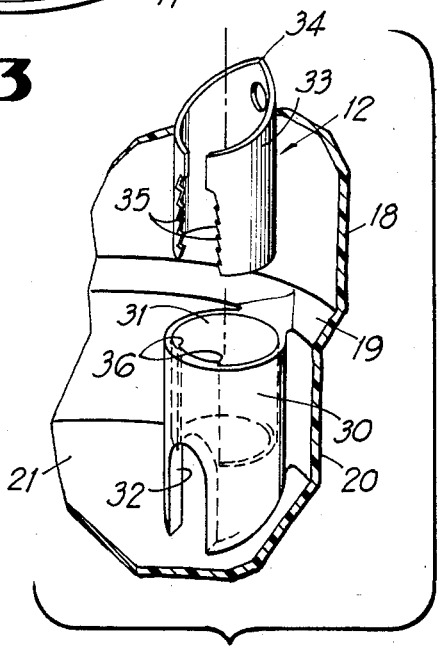
FIG. 5 is an exploded perspective view of components shown in FIG. 4.

The main funnel 11 includes at the lower end of cylindrical wall 18 a narrow conically tapered shoulder 19 against which one end of the container 13 is seated, as indicated in FIG. 2. Below the shoulder 19 a further reduced diameter portion 20 is included on the main funnel 11 leading to a lower end conically tapered portion 21 having an externally threaded neck 22 at its lower end. A further reduced diameter conically tapered spout 23 joined to the neck 22 through a narrow annular shoulder 24 forms the pouring outlet of the main funnel 11, having an outlet diameter $D_1$. Preferably, a strainer element 25 is fitted removably in the bore of neck 22 and rests upon the shoulder 24.

The main funnel is preferably provided with an integral handle 26 extending from one side thereof and a stepped closure plug 27 having diameters $D_1$ and $D_2$ is provided, the use of which will be described. The closure plug 27 has a hanging tab 28 which releasably engages a supporting eye 29 on the top peripheral edge of the primary funnel 11.

The built-in container piercing means 12 comprises an upright axis sleeve 30 formed integrally with the portion or wall 20 of the primary funnel 11, this sleeve having an undercut bore 31 around the larger part of its periphery and having an outlet slot 32 for dispensed liquid at its lower end and interior side immediately above the tapered portion 21. A rolled piercing blade 33 having an upper end piercing point 34 is divided longitudinally with upwardly tapering teeth 35 being provided along its separated edges. The blade 33 is spring-like and biased toward circumferential expansion, so that it will fit snugly into the bore of the sleeve 30 when inserted downwardly therein until the lower end of the piercing blade abuts the conically tapered wall 21, FIG. 2. The teeth engage and tend to bite into vertical lands 36 defined the opposite ends of undercut bore 31, whereby the teeth resist separation of the piercing blade from its sleeve or holder 30.

The secondary pouring spout 14 has a conically tapered body 37 terminating in a reduced diameter cylindrical outlet 38 having the diameter $D_2$ aforementioned. At its top, the secondary spout has an internally threaded coupling sleeve 39 integrally joined therewith through an annular shoulder-forming web 40 near its longitudinal center. Upper screw-threads 41 of this coupling sleeve are sized to receive the threaded neck 22 of primary funnel 11 with the shoulders 24 and 40 in firm contact. The threads 41 are also adapted to receive a standard size threaded outlet sleeve of a bulk storage container, such as a five gallon gasoline can, whereby the present invention also finds utility in assisting in the pouring of gasoline and other liquids from larger containers into smaller containers or into the tanks of vehicles.

The coupling sleeve 39 of secondary pouring spout 14 has lower end internal screw threads 42 adapted to receive the upper end threaded extension 43 of the tertiary spout 15, with the upper end 44 of the spout 15 in abutment with the bottom of shoulder 40. The lower threads 42 may also engage the complimentary threaded neck of a bulk storage container and, when combined with the primary funnel 11, serves as a stable filling system for the container.

The pouring spout 15 is elongated, flexible and somewhat hose-like, being of bellows construction. It terminates at its lower end in a conically tapered spout 45 having a cylindrical outlet 46 also having the outlet diameter $D_2$.

In the use of the system, the container 13 is placed on a solid level surface, the primary funnel 11 is inverted and placed downwardly over the supported container which will enter the cylindrical portion 18 of the funnel. Downward pressure is exerted to cause the piercing blade 33 to penetrate the top wall of the container 13 and the pressure is continued until the tapered shoulder 19 solidly engages the top of the container. At this time, the closure plug 27 may, if desired, be inserted into the pouring spout 23 to close the same, this spout snugly receiving the larger plug portion having the diameter $D_1$. The primary funnel 11 now united with the pierced container 13 can be uprighted to the position shown in FIG. 2 without spilling the liquid. By removing the closure plug 27 from the pouring spout 23, the liquid can be delivered into another container or into the crankcase filling pipe of a vehicle in a highly convenient and satisfactory manner. The container 13 can also be pierced when the primary funnel 11 is in an upright position and liquid flow can commence with or without the closure plug 27.

In instances where the liquid receiver has an inlet too small to receive the pouring spout 23, the secondary spout 14 is attached through its threads 41 with the neck 22 of the primary funnel and the smaller outlet 39 will then be able to deliver the liquid into a smaller receiver inlet. The smaller oulet 38 can be plugged, if desired, by using the smaller diameter portion $D_2$ of the closure plug 27.

When the liquid receiver, regardless of the size of its inlet, is somewhat inaccessible to primary funnel 11 or to the short pouring spout 14, the longer flexible spout 15 is threadedly coupled to the secondary spout 14 through the threads 43 and 42, while the spout 14 remains coupled to the neck 22 of the primary funnel.

It should now be apparent that an extremely convenient and highly versatile liquid filling and/or pouring system is provided in the invention. Containerized liquids can be delivered into almost any receiver at any location without spilling the liquid during the process of filling or pouring it. A user of the device will be able to keep the nearby surroundings clean and help to maintain a safer environment when handling volatile liquids, such as kerosene and gasoline.

A better arrangement for the piercing of a liquid container is afforded by the invention, inasmuch as the primary funnel 11 can be inverted and forced over the top of the container while the latter is solidly supported, as well as having the container pierced when the primary funnel 11 is in an upright position.

The primary funnel 11 also allows the user to grasp it about its stepped outer configuration rather than handle 26. Also, the position of the blade 33 within the primary funnel 11 allows the easy flow of fluid therethrough without utilizing the puncturing function of the blade. Finally, the opening defined by slot 32 affords a means of readily allowing fluid to drain from the blade 33.

The benefits provided by the invention should now be apparent without the necessity for further description herein.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A pouring system for containerized liquids comprising a primary funnel having a receiver chamber for a liquid container and a container piercing means projecting into said chamber, a pouring spout of a first diameter on the primary funnel, said funnel having a threaded coupling neck near said spout, a secondary pouring spout of smaller diameter than the first-named spout adapted to engage telescopically thereover and having an attached coupling including a first threaded portion engageable with the threaded coupling neck and a second threaded portion, and a tertiary elongated flexible pouring spout which is telescopically engageable over the secondary spout, the tertiary spout having a screw-threaded coupling part which is engageable with the second threaded portion of said attached coupling of the secondary pouring spout, said first and second threaded portions sized to optionally fit in threaded engagement with a standard size container, such that said secondary pouring spout may also be used as a spout for said standard size container, said secondary pouring spout combined with said tertiary elongated pouring spout may be used as an elongated spout for said standard size container, and said funnel combined with said secondary pouring spout may be connected to said standard size container to form a sealed funnel connection with said standard size container.

* * * * *